US005487642A

United States Patent [19]

Norton et al.

[11] Patent Number: 5,487,642

[45] Date of Patent: Jan. 30, 1996

[54] TURBINE NOZZLE POSITIONING SYSTEM

[75] Inventors: Paul F. Norton, San Diego, Calif.; James E. Shaffer, Maitland, Fla.

[73] Assignee: Solar Turbines Incorporated, San Diego, Calif.

[21] Appl. No.: 262,179

[22] Filed: Aug. 12, 1994

Related U.S. Application Data

[63] Continuation-in-part of Ser. No. 215,439, Mar. 18, 1994, Pat. No. 5,380,154.

[51] Int. Cl.[6] ..... F04D 29/60

[52] U.S. Cl. ..... 415/209.2

[58] Field of Search ..... 415/189, 190, 415/200, 209.2, 209.3; 60/39.32

[56] References Cited

U.S. PATENT DOCUMENTS

| | | | |
|---|---|---|---|
| 890,635 | 6/1908 | Fox | 415/208.1 |
| 3,867,065 | 2/1975 | Schaller et al. | 415/209.4 |
| 4,260,327 | 4/1981 | Armor et al. | 415/189 |
| 4,391,565 | 7/1983 | Speak | 415/189 |
| 4,768,924 | 9/1988 | Carrier et al. | 415/189 |
| 5,176,496 | 1/1993 | Correia et al. | 415/209.2 |

FOREIGN PATENT DOCUMENTS

| | | | |
|---|---|---|---|
| 722740 | 1/1952 | United Kingdom | 60/39.32 |

*Primary Examiner*—John T. Kwon
*Attorney, Agent, or Firm*—Larry G. Cain

[57] ABSTRACT

A nozzle guide vane assembly having a preestablished rate of thermal expansion is positioned in a gas turbine engine and being attached to conventional metallic components. The nozzle guide vane assembly includes an outer shroud having a mounting leg with an opening defined therein, a tip shoe ring having a mounting member with an opening defined therein, a nozzle support ring having a plurality of holes therein and a pin positioned in the corresponding opening in the outer shroud, opening in the tip shoe ring and the hole in the nozzle support ring. A rolling joint is provided between metallic components of the gas turbine engine and the nozzle guide vane assembly. The nozzle guide vane assembly is positioned radially about a central axis of the gas turbine engine and axially aligned with a combustor of the gas turbine engine.

6 Claims, 5 Drawing Sheets

TURBINE NOZZLE POSITIONING SYSTEM

"The Government of the United States of America has rights in this invention pursuant to Contract No. DE-ACO2-92CE40960 awarded by the U.S. Department of Energy." This is a Continuation-In-Part of application Ser. No. 08/215,439 filed Mar. 18, 1994, now Pat. No. 3,380,154.

TECHNICAL FIELD

This invention relates generally to a gas turbine engine and more particularly to a system for positioning a nozzle guide vane assembly within the gas turbine engine.

BACKGROUND ART

In operation of a gas turbine engine, air at atmospheric pressure is initially compressed by a compressor and delivered to a combustion stage. In the combustion stage, heat is added to the air leaving the compressor by adding fuel to the air and burning it. The gas flow resulting from combustion of fuel in the combustion stage then expands through a nozzle which directs the hot gas to a turbine, delivering up some of its energy to drive the turbine and produce mechanical power.

In order to increase efficiency, the nozzle has a preestablished aerodynamic contour. The axial turbine consists of one or more stages, each employing one row of stationary nozzle guide vanes and one row of moving blades mounted on a turbine disc. The aerodynamically designed nozzle guide vanes direct the gas against the turbine blades producing a driving torque and thereby transferring kinetic energy to the blades.

The gas typically entering through the nozzle is directed to the turbine at an entry temperature from 850 degrees to at least 1200 degrees Fahrenheit. Since the efficiency and work output of the turbine engine are related to the entry temperature of the incoming gases, there is a trend in gas turbine engine technology to increase the gas temperature. A consequence of this is that the materials of which the nozzle vanes and blades are made assume ever-increasing importance with a view to resisting the effects of elevated temperature.

Historically, nozzle guide vanes and blades have been made of metals such as high temperature steels and, more recently, nickel alloys, and it has been found necessary to provide internal cooling passages in order to prevent melting. It has been found that ceramic coatings can enhance the heat resistance of nozzle guide vanes and blades. In specialized applications, nozzle guide vanes and blades are being made entirely of ceramic, thus, imparting resistance to even higher gas entry temperatures.

Ceramic materials are superior to metal in high-temperature strength, but have properties of low fracture toughness, low linear thermal expansion coefficient and high elastic coefficient.

When a ceramic structure is used to replace a metallic part or is combined with a metallic one, it is necessary to avoid excessive thermal stresses generated by uneven temperature distribution or the difference between their linear thermal expansion coefficients. The ceramic's different chemical composition, physical prosperity and coefficient of thermal expansion to that of a metallic supporting structure result in undesirable stresses, a portion of which is thermal stress, which will be set up within the nozzle guide vanes and/or blades and between the nozzle guide vanes and/or blades and their supports when the engine is operating.

Furthermore, conventional nozzle and blade designs which are made from a metallic material are capable of absorbing or resisting more of these thermal stresses. The chemical composition of ceramic nozzles and blades do not have very good characteristic to absorb or resist the thermal stresses. If the stress occurs in a tensile stress zone of the nozzle or blade a catastrophic failure may occur.

The present invention is directed to overcome one or more of the problems as set forth above.

DISCLOSURE OF THE INVENTION

In one aspect of the invention, a system for positioning a nozzle guide vane assembly within a gas turbine engine has a central axis, a combustor and a turbine assembly positioned therein. The system positions the nozzle guide vane assembly in radially spaced relationship to the central axis and the turbine assembly and in axially spaced relationship to the combustor. The system for positioning is comprised of an outer shroud defining an outer surface and having a mounting leg extending radially outwardly therefrom. The mounting leg has an opening therein and the outer shroud is positioned adjacent the combustor. A tip shoe ring defines an inner surface being radially positioned about the turbine assembly and an outer surface having a mounting member extending radially inwardly therefrom. The mounting member has an opening therein being axially aligned with the corresponding opening in the mounting leg. A a nozzle support ring is being positioned in contacting relationship to the tip shoe ring and has a plurality of holes therein. A plurality of pins are positioned in the opening in the mounting leg, the opening in the mounting member and in at least a portion of each of the plurality of holes in the nozzle support ring. The plurality of pins positioning the outer shroud, the tip shoe ring and the nozzle support ring in a ring shaped structure. A means for retaining the plurality of pins from axial movement further comprise the system for positioning.

BEST MODE FOR CARRYING OUT THE INVENTION

Figure 1:
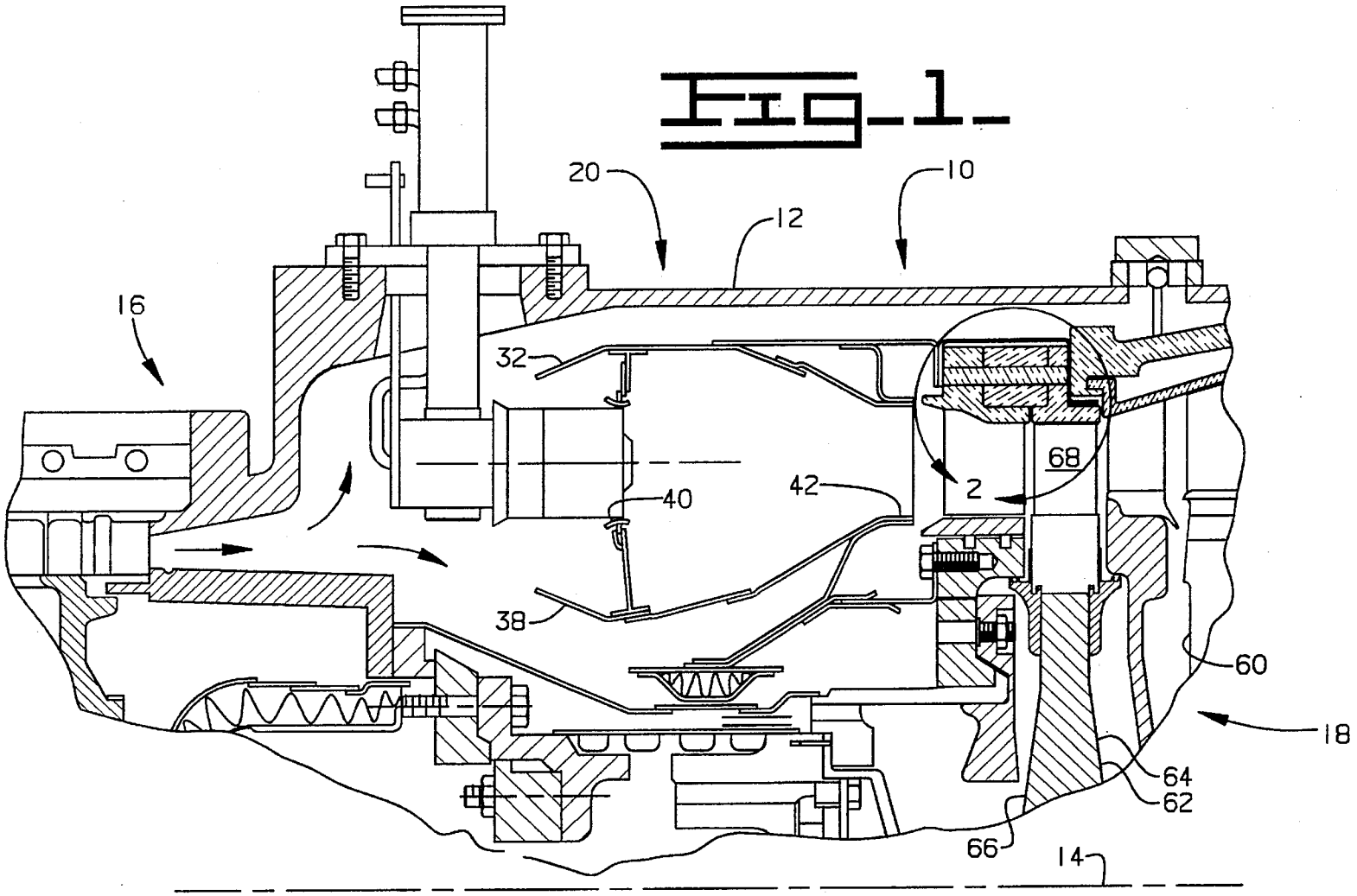
FIG. 1 is a partial side view of a gas turbine engine embodying the present invention with portions shown in section for illustration convenience.

Referring to FIG. 1, a gas turbine engine 10 is shown. The gas turbine engine 10 has an outer housing 12 having a central axis 14. Positioned in the housing 12 and centered about the axis 14 is a compressor section 16, a turbine section 18 and a combustor section 20 positioned operatively between the compressor section 16 and the turbine section 18.

When the engine 10 is in operation, the compressor section 16 causes a flow of compressed air which has at least a part thereof communicated to the combustor section 20 and another portion used for cooling components of the gas turbine engine 10. The combustor section 20, in this application, includes an annular combustor 32. The combustor 32 has an inlet end 38 having a plurality of generally evenly spaced openings 40 therein and an outlet end 42. Each of the openings 40 has an injector 50 positioned therein.

The turbine section 18 includes a power turbine 60 having an output shaft, not shown, connected thereto for driving an accessory component, such as a generator. Another portion of the turbine section 18 includes a gas producer turbine 62 connected in driving relationship to the compressor section 16. The gas producer turbine 62 includes a turbine assembly 64 being rotationally positioned about the central axis 14. The turbine assembly 64 includes a disc 66 having a plurality of blades 68 attached therein in a conventional manner.

Figure 2:
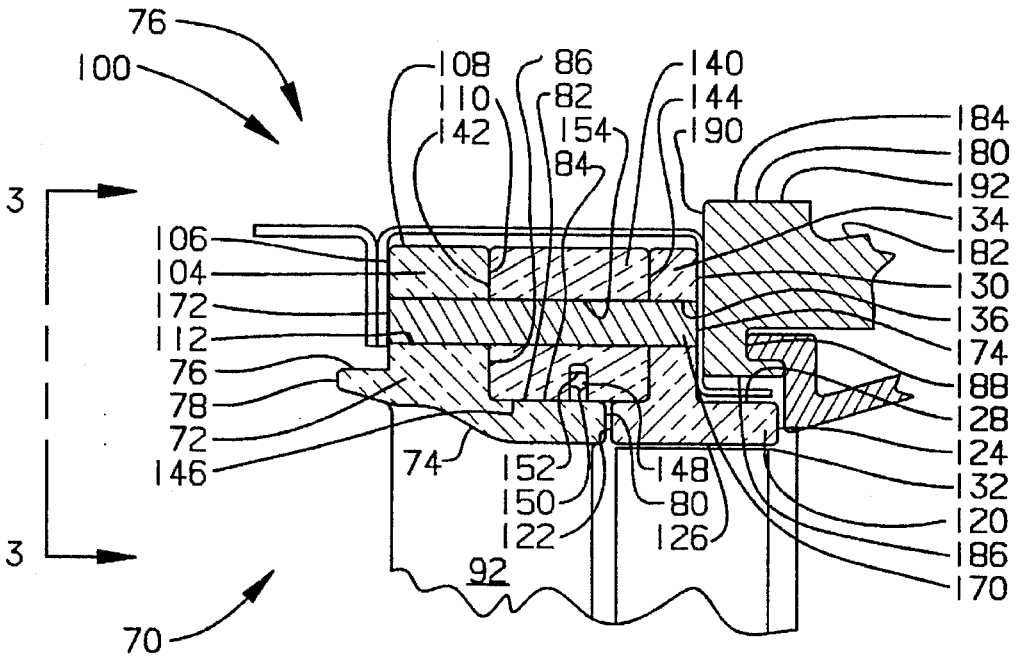
FIG. 2 is an enlarged sectional view of a portion of the gas turbine engine having a nozzle guide vane assembly as taken through a mounting pin within line 2 of FIG. 1.
Figure 3:
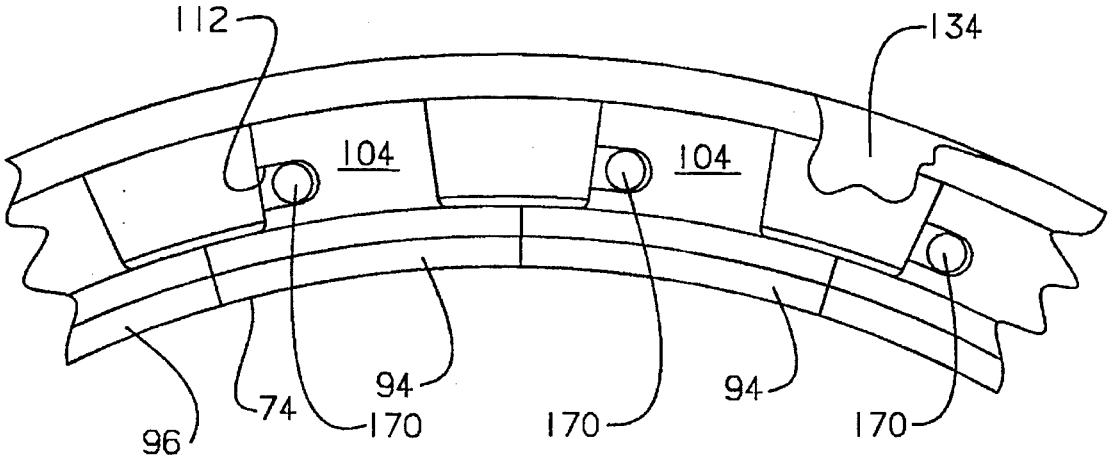
FIG. 3 is an enlarged sectional view of a portion of the gas turbine engine taken along lines 3—3 of FIG. 2.
Figure 4:
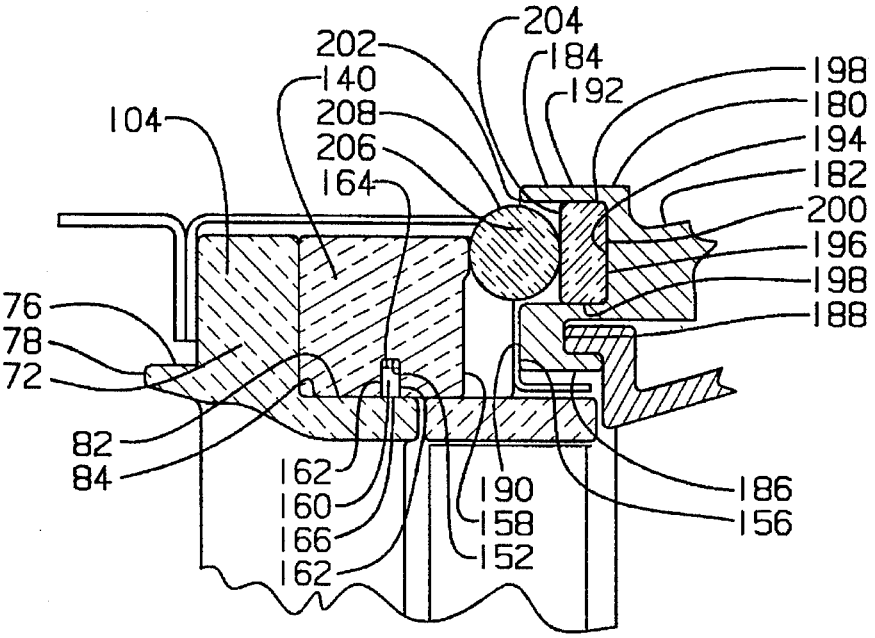
FIG. 4 is an enlarged sectional view of a portion of the gas turbine engine having a nozzle guide vane assembly as taken between a mounting pin within line 2 of FIG. 1.

As further shown in FIGS. 2, 3 and 4, positioned adjacent the outlet end 42 of the combustor 32 and in flow receiving communication therewith is a nozzle guide vane assembly 70. The nozzle guide vane assembly 70 is made of a ceramic material having a relatively low rate of thermal expansion as compared to the metallic components of the engine 10. As an alternative, the nozzle guide vane assembly 70 could be made of the same material and have the same rate of thermal expansion as the metallic components of the engine 10. The nozzle guide vane assembly 70 includes an outer shroud 72 defining a radial inner surface 74, a radial outer surface 76, a first end 78 being spaced from the outlet end 42 a predetermined distance and a second end 80. The radial outer surface 76 includes a step 82 extending from the second end 80 toward the first end 78 and defines a generally axial base 84 and a generally radial leg 86. A plurality of vanes 92 are evenly spaced about the radial inner surface 74 of the outer shroud 72 and are attached thereto. Furthermore, the nozzle guide vane assembly 70 includes a plurality of segments 94. When the plurality of segments 94 are assembled they form a ring shaped structure 96 centered about the central axis 14. As an alternative, the outer shroud 72 and the plurality of vanes 92 could be a single ring.

A means 100 for positioning the plurality of segments 94 within the gas turbine engine is provided and includes the following components. Each of the plurality of segments 94 includes a mounting leg 104 defining a first surface 106 being spaced inwardly from the first end 78 of the outer shroud 72 and extending radially outwardly from the radial outer surface 76 of the outer shroud 72 to an outer surface 108. A second surface 110 is axially spaced from the first surface 106 a predetermined distance and extends radially inwardly from the outer surface 108 and aligns with the leg 86 of the step 82 of the radial outer surface 76 of the outer shroud 72. The mounting leg 104 includes an opening 112 being radially spaced about the central axis 14 and extending between the first surface 106 and the second surface 110. As an alternative, a plurality of openings 112 could be used without changing the essence of the invention. The opening 112 is positioned radially outwardly from the radial outer surface 76 of the outer shroud 72 and radially inwardly from the outer surface 108 of the mounting leg 104.

Axially spaced from the outer shroud 72 is a generally cylindrical tip shoe ring 120 defining a nozzle end 122, a turbine end 124, an inner surface 126 and an outer surface 128. The tip shoe ring 120, in this application, includes a plurality of segments 130 but, as an alternative, could be a single ring. The tip shoe ring 120 is made of a ceramic material having a relative low rate of thermal expansion as compared to the metallic components of the engine 10. As an alternative, the cylindrical tip shoe ring 120 could be made of the same material and have the same rate of thermal expansion as the metallic components of the engine 10. The inner surface 126 of the ring 120 is radially spaced from the blades 68 a preestablished distance forming a tip clearance 132. Each of the segments 130 of the ring 120 further includes a mounting member 134 extending radially outwardly from the outer surface 128. The mounting member 134 is spaced inwardly from the nozzle end 122 and the turbine end 124. The mounting member 134 includes an opening 136 being radially spaced about the central axis 14 a preestablished distance equal to the radial spacing of the opening 112 in the mounting leg 104 of the plurality of segments 94. As an alternative, a plurality of openings 136 could be used without changing the essence of the invention. The opening 136 in the mounting member 134 is axially and radially aligned with a respective one of the openings 112 in the plurality of segments 94.

A nozzle support ring 140 is interposed the mounting leg 104 of the plurality of segments 94 and the mounting member 134 of each of the segments 130 of the ring 120. The nozzle support ring 140 is made of a ceramic material having a relative low rate of thermal expansion as compared to the metallic components of the engine 10. As an alternative, the nozzle support ring 140 could be made of the same material and have the same rate of thermal expansion as the metallic components of the engine 10. The nozzle support ring 140 has a generally rectangular cross-sectional configuration. The nozzle support ring 140 defines a first radially extending surface 142 being in generally contacting relationship with the mounting leg 104 of each of the plurality of segments 94. The nozzle support ring 140 further defines a second radially extending surface 144 being in generally contacting relationship with the mounting member 134 of each of the plurality of segments 130 of the ring 120. The nozzle support ring 140 further defines an inner surface 146 extending between the first radially extending surface 142 and the second radially extending surface 144. An annular groove 148 is defined in the inner surface 146. The annular groove 148 includes a pair of sides 150 and a bottom 152. The inner surface 146 is radially spaced from the base 84 of the step 82 in the outer surface 76 of the outer shroud 72. The annular groove 148 is positioned in axial alignment about the base 84. The first radially extending surface 142 is in generally contacting relationship with the leg 86 of the step 82. A plurality of holes 154 extend from the first radially extending surface 142 through the nozzle support ring 140 to the second radially extending surface 144. The plurality of holes 154 are radially spaced about the central axis 14 a preestablished distance equal to the radial spacing of the opening 112 in the mounting leg 104 of the plurality of segments 94 and the openings 136 in the mounting members 134 of the plurality of segments 130. Respective ones of the plurality of holes 154 are aligned with respective ones of the openings 136 in each of the mounting members 134 and the opening 112 in the mounting legs 104. A plurality of bosses 156 extend from the second radially extending surface 144 and are interposed a portion of the plurality of holes 154. In this application, three bosses 156 are used. A radial extending groove 158 having a generally arcuate cross-section is positioned in each of the bosses 156. As an alternative, the arcuate crosssection could have a generally "V" shaped configuration.

An annular sealing ring 160 is positioned in the annular groove 148. The annular sealing ring 160 is of conventional construction and is split and has the ability to expand and contract within the annular groove 148. The annular sealing ring includes a pair of sides 162 which are in sliding relationship the pair of sides of the annular groove 148. The annular sealing ring 160 further includes a radial outer surface 164 spaced from the bottom portion 152 of the annular groove 148 a preestablished distance and a radial inner surface 166 extending radially inwardly of the inner surface 146 of the nozzle support ring 140. The radial inner surface 166 of the annular sealing ring 160 is in contacting relationship with the base 84 of the step 82 of the outer surface 76 of the outer shroud 72.

A plurality of pins 170 having a first end 172 and a second end 174 define a predetermined length. Each of the plurality of pins 170, in this application, is made of a metallic material but, as an alternative, could be made of a ceramic material. Each pin 170 is positioned in a corresponding one of the openings 112 in the mounting leg 104 of the plurality of segments 94, plurality of holes 154 in the nozzle support ring 140 and the opening 136 in the mounting member 132 of the plurality of segments 130. A retaining means 176 of conventional design is provide to prevent axial movement of the pins 170 within the openings 112,136 and the holes 154.

Attached to the outer housing 12 of the gas turbine engine 10 is an annular support 180. The annular support 180 has a first end, not shown, attached to the outer housing 12 in a conventional manner. A frustoconical wall 182 extends generally radially inwardly from the first end to an end portion 184. The end portion 184 includes an inner hook 186 having a notch 188 therein. The notch 188 opens away from the tip shoe ring 120. Additional components of the gas turbine engine 10 are supported from the inner hook 186 in a conventional manner. The end portion 184 further includes a generally radial surface 190 extending outwardly from the inner hook 186 and terminates at an outer surface 192. A plurality of circumferential notches 194 are defined in the radial surface 190 of the end portion 184 and have a preestablished contour, such as a quarter moon shaped configuration. Each of the plurality of notches 194 is interposed the outer surface 192 and the inner hook 186. Each of the plurality of notches 194 has a bearing block 196 positioned therein. Each of the bearing blocks 196 has a pair of sides 198 and a bottom 200 generally positioned in contacting relationship to the contour of each notch 194. The bearing block 196 further defines a surface 202 in which is positioned a bearing groove 204 having a generally arcuate cross-section. As an alternative, the arcuate cross-section could have a generally "V" shaped configuration. In the assembled position, a plurality of spherical bearings 206 are interposed the bearing blocks 196 and the nozzle support ring 140. The spherical bearing 206 has a bearing surface 208 which is in rolling contact with the arcuate cross-section of the bearing groove 204 in each of the bearing blocks 196 and the arcuate cross-section of the radially extending groove 158 in each of the bosses 156 on the nozzle support ring 140. In this application, the spherical bearing 206 is made of a ceramic material; however, as an alternative the spherical bearing could be made of another suitable material, such as steel.

Figure 5:
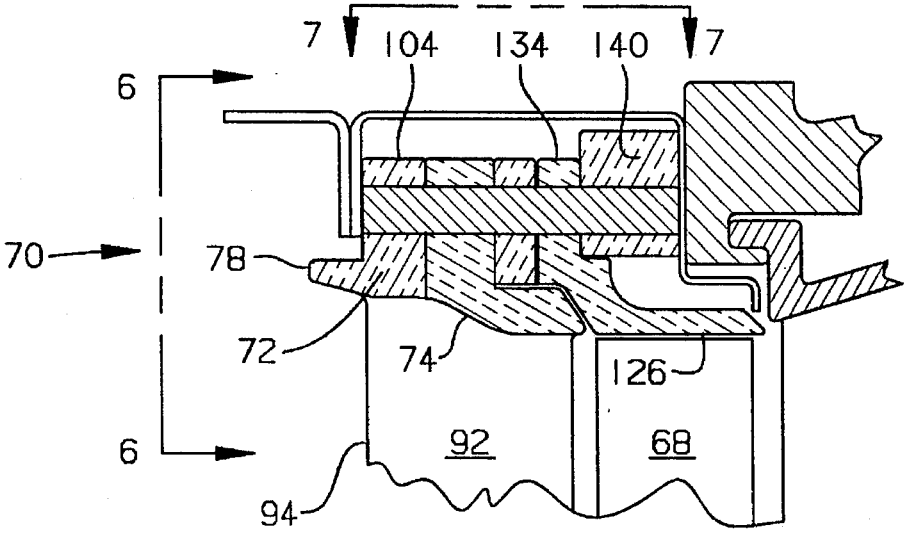
FIG. 5 is an enlarged sectional view of the gas turbine engine having an alternative nozzle guide vane assembly as taken through a mounting pin within line 2 of FIG. 1.
Figure 6:
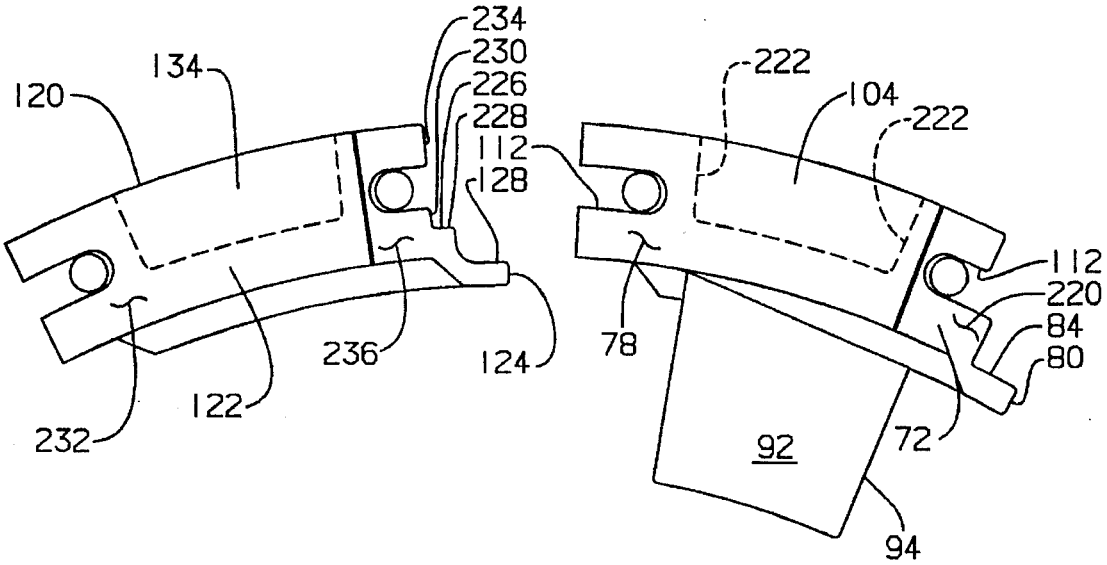
FIG. 6 is an exploded enlarged sectional view of the alternative nozzle guide vane assembly taken along lines 6—6 of FIG. 5.
Figure 7:
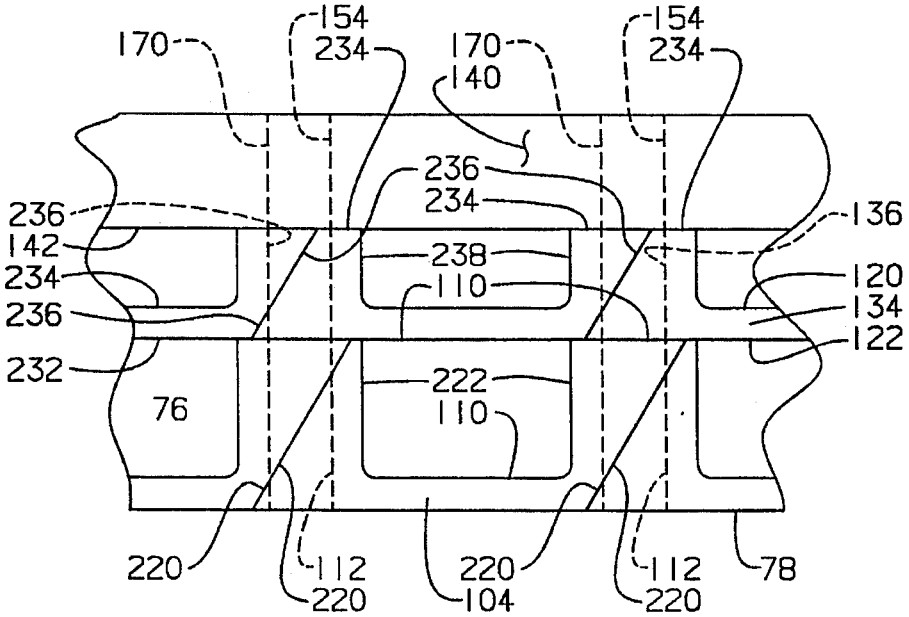
FIG. 7 is an enlarged elevational view of the alternative nozzle guide vane assembly taken along lines 7—7 of FIG. 5.

An alternative of the nozzle guide vane assembly 70 is best shown in FIGS. 5, 6 and 7. The outer shroud 72, the plurality of vanes 92 attached thereto and the plurality of segments 94 remain as generally described above. However, the plurality of segments 94 have been modified slightly. For example, each of the plurality of segments 94 include an pair of abutting sides 220 which in this alternative has been formed at an angle. The angle, in this application, is about 60 degrees to the first end 78 and extends from the first end 78 to the second end 80. Furthermore, a plurality of bosses 222 have been attached to the second surface 110 of the mounting leg 104. The angle is also formed in a portion of the plurality of bosses 222. The opening 112 included in the mounting leg 104 has been increased to a plurality of openings 112. Each of the plurality of openings 112 extends through one of the plurality of bosses 222.

The tip shoe ring 120 has also been modified. For example, the mounting member 134 extends radially outwardly from the outer surface 128 but is aligned with the nozzle end 122. The outer surface 128 includes a step 226 extending between the nozzle end 122 and the turbine end 124. The step has a generally axial base 228 and a generally radial leg 230. The mounting member 134 further defines a first surface 232 which extends radially in alignment from the outer surface 128 of the tip shoe ring 120. A second surface 234 is spaced from the first surface 232 and aligned radially with the leg 230 of the step 226 in the outer surface 128 of the tip shoe ring 120. The tip shoe ring 120 further includes a pair of abutting sides 236 which in this alternative has been formed at an angle. The angle, in this application, is about 60 degrees to the nozzle end 122 and extends from the nozzle end 122 to the turbine end 124. Furthermore, a plurality of bosses 238 have been attached to the second surface 234 of the mounting member 134. The angle is also formed in a portion of the plurality of bosses 238. The opening 136 included in the mounting member 134 has been increased to a plurality of openings 136. Each of the plurality of openings 136 extend through one of the plurality of bosses 238 and is aligned with corresponding ones of the plurality of openings 112 in the mounting leg 104.

In this alternative, the first surface 232 of the tip shoe ring 120 is positioned in contacting relationship to the second surface 110 of the mounting leg 104 of the plurality of segments 94. Corresponding ones of the plurality of openings 112 in the mounting leg 104 are aligned with corresponding ones of the plurality of openings 136 in the mounting member 134. The nozzle support ring 140 has the first radially extending surface 142 positioned in contacting relationship with the second surface 234 of the mounting member 134 and corresponding ones of the plurality of holes 154 are aligned with corresponding ones of the plurality of openings 136 in the mounting member 134. Individual pins 170 are inserted within corresponding ones of the plurality of openings 112 in the mounting leg 104, the plurality of openings 136 in the mounting member 134 and the plurality of holes 154. The rolling joint between the spherical bearing 206 and the nozzle support ring 140 remains unchanged.

Figure 8:
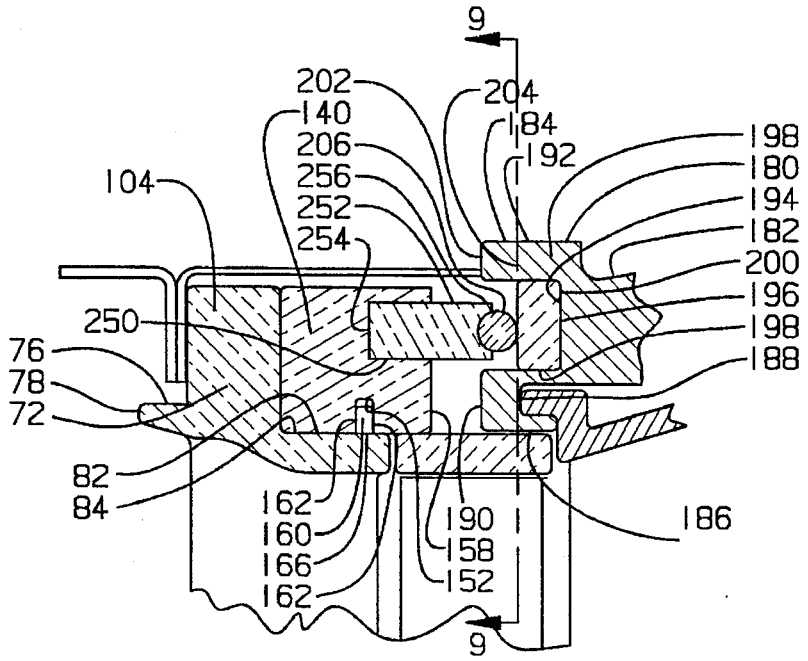
FIG. 8 is an enlarged sectional view of an alternate embodiment of the interface between an annular support of the engine and a nozzle support ring.
Figure 9:
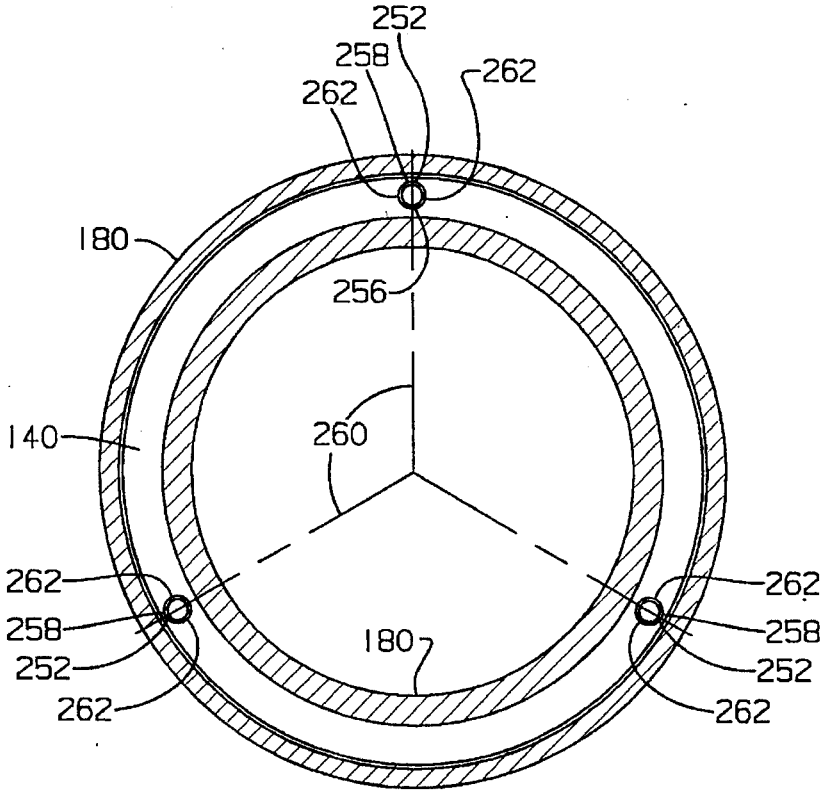
FIG. 9 is an enlarged view of the interface of an alternate embodiment taken along line 9—9 of FIG. 8.

An alternative structure of the rolling joint is best shown in FIGS. 8 and 9. As an alternative to the three bosses 156 which extend from the second radially extending surface 144 and are interposed a portion of the plurality of holes 154, a plurality of positioning holes 250, three in actuality, replace the bosses 156. Positioned in each of the plurality of positioning holes 250 is a raceway plug 252 being made of a ceramic material. A first end 254 of the raceway plug 252 is positioned in one of the plurality of positioning holes 250. A second end 256 of the raceway plug 252 has a generally cylindrical groove 258 positioned therein. The generally cylindrical groove 258 has an axis 260 defined thereon and forms a pair of shoulders 262.

In the assembled condition, as best shown in FIG. 8, the plurality of positioning holes 250 are equally spaced about the second radially extending surface 144 and have an angle of about 120 degrees therebetween. The axis 260 of the cylindrical groove 258 is aligned with an axis of the angle. One of each of the plurality of spherical bearings 206 is interposed the raceway plug 252 and the bearing groove 204 or as a further alternative the radial surface 190 of the annular support 180.

Thus, the nozzle guide vane assembly 70 is radially supported about the central axis 14. Expansion of the nozzle guide vane assembly 70 relative to the mounting components of the gas turbine engine 10 are compensated for by the rolling joint between the spherical bearing 206 and the nozzle support ring 140 of the nozzle guide vane assembly 70 and the bearing blocks 196 positioned in the annular support 180 of the gas turbine engine 10 or between the spherical bearing 206 and the radial surface 190 of the annular support 180. Furthermore, thermal expansion due to the different rates of thermal expansion of the materials used in the gas turbine engine 10 are compensated for by the rolling joint between the spherical bearing 206 and the nozzle support ring 140 and the bearing blocks 196 or between the spherical bearing 206 and the radial surface 190 of the annular support 180.

Industrial Applicability

In use, the gas turbine engine 10 is started and allowed to warm up and is used in any suitable power application. As the demand for load or power is increased, the engine 10 output is increased by increasing the fuel and subsequent air resulting in the temperature within the engine 10 increasing. In this application, the components used to make up the nozzle guide vane assembly 70, being of different materials and having different rates of thermal expansion, grow at different rates and the forces resulting therefrom and acting thereon must be structurally compensated for to increase life and efficiency of the gas turbine engine. The structural arrangement of the nozzle guide vane assembly 70 being made of a ceramic material requires that the nozzle guide vane assembly 70 be generally isolated from the conventional materials to insure sufficient life of the components.

For example, the means 100 for positioning the nozzle guide vane assembly 70 within the gas turbine engine 10 positions the nozzle guide vane assembly 70 in direct contact and alignment with the hot gases from the combustor 42. The plurality of segments 94 of the outer shroud 72, the plurality of segments 130 of the tip shoe ring 120 and the nozzle support ring 140 are connected and form the nozzle guide vane assembly 70 by way of a plurality of pinned connections. For example, near the radial extremity of each of the plurality of segments 94, a pin 170 is positioned through the opening 112 in each of the mounting legs 104, the opening 136 in each of the mounting members 134 and the corresponding one of the plurality of holes 154 in the nozzle support ring 140. The second end 174 is restricted from axial movement toward the turbine assembly 64 by the annular support 180. The first end 172 is restricted from axial movement toward the outlet end 42 of the combustor 32 by the retaining means 176. Thus, the pins 152 position each of the segments 94 radially about the central axis 14. The pins 152 further position the tip shoe ring 108 radially about the central axis 14 and the turbine assembly 64. The inner surface 126 of the tip shoe ring 108 and the blades 68 on the turbine assembly 64 form the preestablished tip clearance 116. The plurality of pinned joints further position the nozzle guide vane assembly 70 in direct contact and alignment with the hot gases from the combustor 42.

The rolling joint formed by the plurality of spherical bearings 206 having the bearing surface 208 in contacting and rolling relationship to arcuate grooves 158 in the nozzle support ring 140 and the arcuate bearing groove 204 in the bearing blocks 196 positioned in the annular support 180 provides a rolling joint. Thus, compensation for the thermal expansion and relative movement between the nozzle guide vane assembly 70 relative to the mounting components of the gas turbine engine 10 is provided.

The annular sealing ring 160 serves two functions. The sealing ring 160 reduces the escape of hot energy containing gases from the nozzle guide vane assembly 70 between the individual components. Furthermore, the sealing ring 160 tends to center or align each of the plurality of segments 94 of the outer shroud 72. In the assembled position, the inner surface 166 of the sealing ring 160 is in contacting relationship with the base 84 of the step 82 in the outer surface 76 of the outer shroud 72. Thus, the annular configuration of the sealing ring 160 tends to align the plurality of segments 94 of the outer shroud 72 into the ring shaped structure 96.

Thus, in view of the foregoing, it is readily apparent that the structure of the present invention results in the interface between components making up the nozzle guide vane assembly 70 have components pinned one to another providing alignment of the individual components of the nozzle guide vane assembly 70 with the outlet 42 of the combustor 32 and centered about the central axis 14. The expansion of the ceramic nozzle guide vane assembly 70 and the expansion of the metallic components of the gas turbine engine 10 are compensated for by the rolling interface. Thus, avoiding a highly stressed zone or area of the nozzle guide vane assembly 70 which could result in a catastrophic failure.

Other aspects, objects and advantages of this invention can be obtained from a study of the drawings, the disclosure and the appended claims.

We claim:

1. A system for positioning a nozzle guide vane assembly within a gas turbine engine having a central axis, a combustor and a turbine assembly positioned therein, said system positioning the nozzle guide vane assembly in radially spaced relationship to the central axis and the turbine assembly and in axially spaced relationship to the combustor, said system for positioning comprising:

an outer shroud defining an outer surface and having a mounting leg extending radially outwardly therefrom, said mounting leg having an opening therein, said outer shroud being positioned adjacent the combustor;

a tip shoe ring defining an inner surface being radially positioned about the turbine assembly and an outer surface having a mounting member extending radially inwardly therefrom, said mounting member having an opening therein being axially aligned with the corresponding opening in the mounting leg;

a nozzle support ring being positioned in contacting relationship to the tip shoe ring and having plurality of holes therein;

a support structure and a spherical bearing being interposed the nozzle support ring and a support structure being attached to the gas turbine engine;

a plurality of pins being positioned in the opening in the mounting leg, the opening in the mounting member and in at least a portion of each of the plurality of holes in the nozzle support ring, said plurality of pins positioning the outer shroud, the tip shoe ring and the nozzle support ring in a ring shaped structure and;

means for retaining the plurality of pins from axial movement.

2. The system for positioning a nozzle guide vane assembly within a gas turbine engine of claim 1 wherein said support structure includes a plurality of notches positioned therein having a bearing block positioned in each of the plurality of notches, each of said plurality of bearing blocks having a groove therein contacting the spherical bearing.

3. The system for positioning a nozzle guide vane assembly within a gas turbine engine of claim 2 wherein said nozzle support ring further includes a radially extending groove, each of said radially extending groove and the groove in each of the plurality of bearing blocks have a generally arcuate configuration.

4. The system for positioning a nozzle guide vane assembly within a gas turbine engine of claim 1 wherein said outer surface includes a first end being spaced from the combustor and a second end, a step extends from the second end toward the first end and defines a base and said nozzle support ring defines a first surface, a second surface and an inner surface extending between the first and second surfaces, said inner surface having a groove therein, and a sealing ring positioned in the groove and contacting the base.

5. The system for positioning a nozzle guide vane assembly within a gas turbine engine of claim 4 wherein said sealing ring has an annular configuration.

6. The system for positioning a nozzle guide vane assembly within a gas turbine engine of claim 5 wherein said sealing ring is of the split design.

* * * * *